US005103758A

United States Patent [19]

Clark

[11] Patent Number: 5,103,758

[45] Date of Patent: Apr. 14, 1992

[54] BOOKMARK

[76] Inventor: Kevin P. Clark, 120 Sunny Reach Dr., West Hartford, Conn. 06117

[21] Appl. No.: 687,165

[22] Filed: Apr. 18, 1991

[51] Int. Cl.[5] ..... B42D 9/00; A44B 11/25; A44C 5/18

[52] U.S. Cl. ..... 116/237; 116/234; 24/265 EC

[58] Field of Search ..... 116/234, 237, 238, 239; 24/67 R, 460, 462, 265 EC, 265 BC; 40/1.5, 1.6, 663; 281/42

[56] References Cited

U.S. PATENT DOCUMENTS

| | | | |
|---|---|---|---|
| 472,632 | 4/1892 | Watson | 116/238 |
| 1,540,777 | 6/1925 | Hellerman | 116/239 |
| 1,710,062 | 4/1929 | Moore | 281/42 X |
| 1,975,000 | 9/1934 | Beaumont et al. | 24/460 X |
| 2,609,629 | 9/1952 | Hubbard | 116/234 X |
| 2,716,390 | 8/1955 | Goins | 116/234 |
| 2,717,572 | 9/1955 | Kingman | 281/42 X |
| 2,911,940 | 11/1959 | Greider | 116/239 |
| 3,308,784 | 3/1967 | Miller | 116/237 |
| 3,381,654 | 5/1968 | Hupp et al. | 116/237 |
| 4,128,194 | 12/1978 | Hinz | 24/460 X |
| 4,487,156 | 12/1984 | Frost | 116/239 |

FOREIGN PATENT DOCUMENTS

| | | | |
|---|---|---|---|
| 0511674 | 6/1952 | Belgium | 116/239 |
| 0582451 | 7/1933 | Fed. Rep. of Germany | 116/239 |
| 3202077 | 8/1983 | Fed. Rep. of Germany . | |
| 3836615 | 5/1990 | Fed. Rep. of Germany | 116/234 |
| 2485442 | 12/1981 | France . | |
| 2533168 | 3/1984 | France . | |
| 0068938 | 3/1945 | Netherlands | 116/237 |
| 0018966 | of 1891 | United Kingdom . | |
| 0016885 | of 1905 | United Kingdom . | |
| 0220401 | 8/1924 | United Kingdom | 116/237 |
| 0282998 | 1/1928 | United Kingdom | 116/239 |
| 2150077 | 6/1985 | United Kingdom . | |

*Primary Examiner*—William A. Curhlinski, Jr.
*Assistant Examiner*—John L. Beres
*Attorney, Agent, or Firm*—Chilton, Alix & Van Kirk

[57] ABSTRACT

A transferable bookmark which can be clipped to one or more pages, or to the cover, of a book. The bookmark includes a ribbon, one end of which is mounted between a flexible clip and a ribbon cover. The clip includes an inner clipping member which is hinged to an outer clipping member, allowing resilient displacement of the inner and outer clipping members relative to one another. The ribbon cover is mounted on the back side inner clipping member, over the ribbon. The inner clipping member can have a name plate adhered to the front, displaying a letter or symbol thereon.

16 Claims, 4 Drawing Sheets

BOOKMARK

BACKGROUND OF THE INVENTION

The present invention generally relates to bookmarks and more particularly relates to a bookmark which can be clipped to a page, or to the cover, of a book.

Bookmarks which commonly are used to mark a page in a book include rectangular pieces of paper, cardboard, or plastic which can be transferred from one book to another. This type of bookmark can be disadvantageous, however, because it can slide into the center of a large book, making it more difficult for the reader to find the marked page, and will, on occasion, fall out of a book of any size, particularly when the bookmark is slippery.

Another conventional type of bookmark is a ribbon which is attached to the spine at the top of the book and extends downward along a page. This type of bookmark has limited utility, because it is not transferable and ordinarily is used only in hardcover books.

SUMMARY OF THE INVENTION

An object of the invention is to provide a bookmark which can be removably attached to a page, or to the cover, of a book.

Another object of the invention is to provide a bookmark which is unlikely to fall out of a book or become lost in the pages of a large book.

Yet another object of the invention is to provide a transferable clip bookmark which can be produced economically.

Briefly stated, the invention in a preferred form is a bookmark comprising a flat clip, a flat ribbon cover, and an elongated ribbon, one end of which is sandwiched between the clip and the ribbon cover.

The clip includes a planar inner clipping member having a top portion, a bottom portion, opposite front and back faces, and a rim on the back face. The rim defines the outer edge of the inner clipping member, and also defines a rectangular recess which receives one end of the ribbon. The ribbon is mounted in the recess such that the length of the ribbon is parallel to the direction from the top portion of the inner clipping member to the bottom portion, and the ribbon extends outward from the top of the clip. The clip includes an outer clipping member which extends around the outer edge of the inner clipping member. The outer clipping member includes a first segment which is attached at each end to a second segment. The first and second segments define the inner edge of the outer clipping member, which edge has substantially the same shape as the outer edge of the inner clipping member. The clip further includes a hinge which resiliently attaches the top portion of the inner clipping member to the first segment of the outer clipping member. The unhinged portion of the inner clipping member is separated from the outer clipping member by a gap of at least about 0.03 inches. In a preferred embodiment, the inner and outer clipping members lie in parallel planes, and are substantially, but not exactly coplanar.

To form the bookmark, the ribbon is placed in the recess on the back face of the inner clipping member, and a flat ribbon cover is mounted over the ribbon, sandwiching the ribbon between the inner clipping member and the ribbon cover.

BRIEF DESCRIPTION OF THE PREFERRED EMBODIMENT

Figure 1:
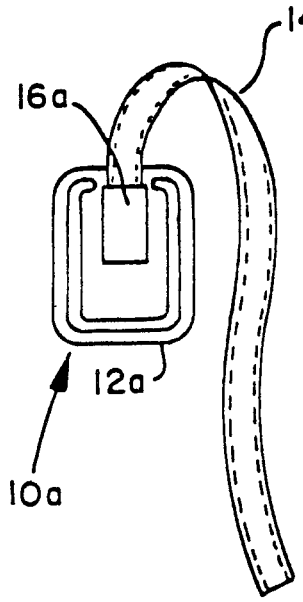
FIGS. 1(*a*)–1(*c*) show front views of various embodiments of a bookmark according to the present invention.
Figure 1:
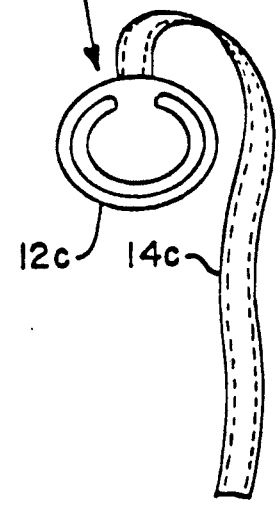
Figure 1:
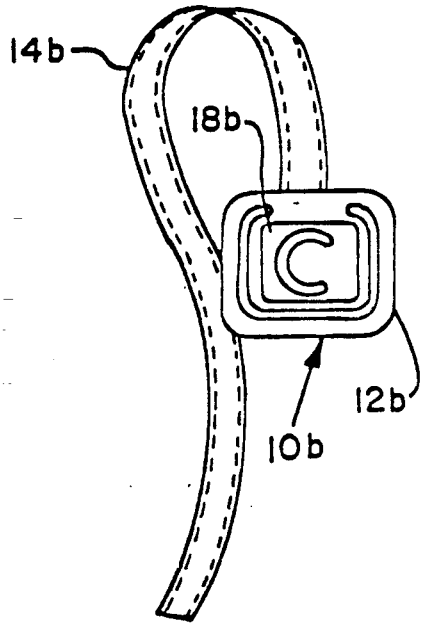
Figure 3:
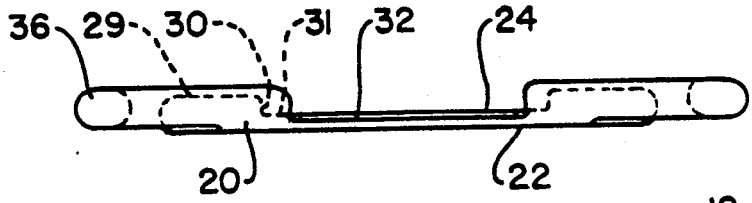
FIG. 3 is a top view, partly in phantom, of the clip shown in FIG. 2.
Figures 6, 7:
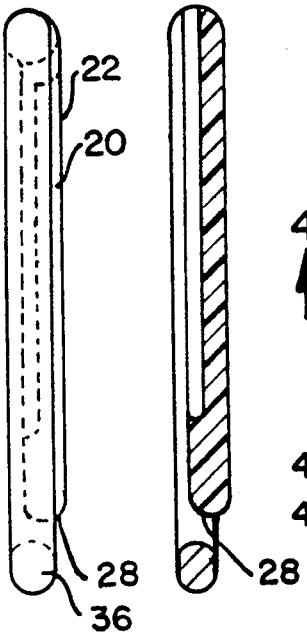
FIG. 6 is a cross-sectional view of the clip shown in FIG. 2, taken along line 6—6.
FIG. 7 is a side view, partly in phantom, of the clip shown in FIG. 2, viewed from the left.
Figure 2:
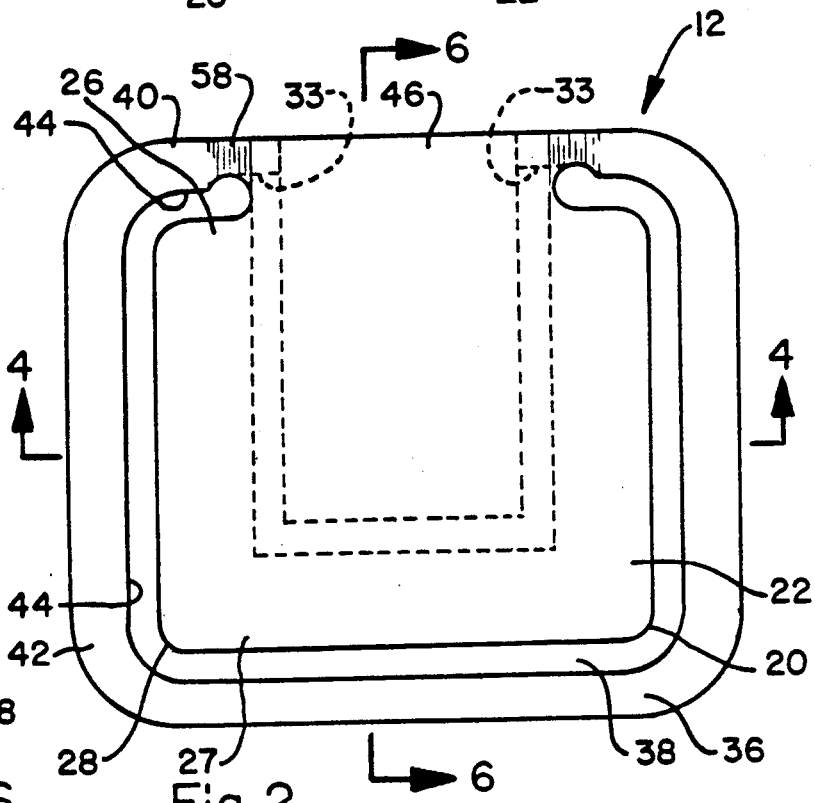
FIG. 2 is a front view, partly in phantom, of a first embodiment of a clip for the bookmark of the present invention.
Figure 4:
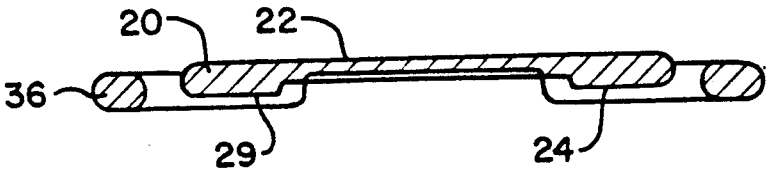
FIG. 4 is a cross-sectional view of the clip shown in FIG. 2, taken along line 4—4.
Figure 5:
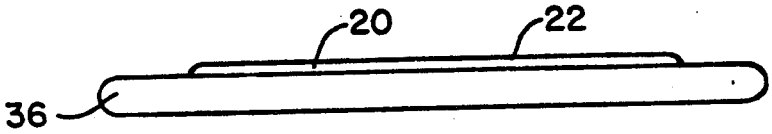
FIG. 5 is a bottom view of the clip shown in FIG. 2.

Referring now to the drawings in detail wherein like numerals represent the same or like parts throughout, and referring particularly to FIG. 1, three embodiments of the bookmark 10*a*–10*c* according to the present invention are illustrated. Bookmark 10*a* is shown from the back, and has a rectangular plastic clip 12*a*, a ribbon 14*a*, made of any suitable material, and a plastic ribbon cover 16*a*. The ribbon 14*a* is sandwiched between the clip 12*a* and the ribbon cover 16*a*, and extends outward from the upper end of the clip 12*a*. The clip 12*a* is rectangular, measuring 1 inch by ¾ inch by 1/16 inch. Bookmark 10*b*, which is shown from the front, has a rectangular clip 12*b*, a ribbon 14*b* which is sandwiched between a clip 12*b* and a ribbon cover (not shown), and a name plate 18*b* adhered to the front of the clip 12*b*. The ribbon 14*b* extends outward from the top of the clip 12*b*. The clip 12*b* is square, measuring about 1 inch along each side. Bookmark 10*c*, shown from the front, is similar to bookmark 10*a*, except that the clip 12*c* is circular, rather than rectangular. The clip 12*c* has a diameter of about 1 inch and a thickness of about 1/16 inch.

In FIGS. 2–7, a clip 12 is shown having a solid, planar rectangular inner clipping member 20 including a front face 22, an opposite back face 24, a top portion 26, a bottom portion 27, and an outer edge 28. The front face 22 is flat. The back face 24 has a wide rim 29 which defines a substantially rectangular recess 30. The recess 30 has a partially recessed, 3-sided outer ledge 31 defining a rectangular, deeper, inner recess 32 which is dimensioned to receive a ribbon (not shown) and extends to the top edge of the clip 12. The length of the ribbon extends in a direction parallel to the direction from the bottom portion 27 to the top portion 26 of the inner clipping member 20. The recess 30 is dimensioned to receive the ribbon cover 16, which bonds to the ledge 31, as is discussed below in further detail. The recess 30 has upper walls 33, joining the back face 24 of the inner clipping member 20 and the ledge 31. The upper walls 33 guide the placement of the ribbon cover 16 in the recess 30.

The plastic clip 12 also includes a flat outer clipping member 36 which lies nearly, but not exactly, in the same plane as the inner clipping member 20, and extends around the outer edge 32 of the inner clipping member 20. The inner clipping member 20 and outer clipping member 36 lie in parallel planes, which are separated by about 0.02 inches in a direction perpendicular to their planes. The front face 22 of the inner clipping member 20 protrudes outward relative to the plane of the outer clipping member 36. A substantial portion of the outer clipping member 36 also is separated from the outer edge of the inner clipping member 20 in a direction parallel to the plane of the outer clipping member 36, by a substantially uniform gap 38 of about 0.03 inches. The inner clipping member 20 and the outer clipping member 36 have substantially the same thickness.

The outer clipping member 36 includes a straight first portion 40 which is attached at each end to one end of a quasi C-shaped segment 42. The quasi C-shaped segment 42 has an inner edge 44. In the embodiment illustrated in FIGS. 2–4, the shape of the inner edge 44 of the outer clipping member 36 is the same as the shape of the outer edge 28 of the inner clipping member 20, i.e., rectangular with rounded corners.

The top portion 26 of the inner clipping member 20 is coupled by a resilient hinge 46 to the first portion 40 of the outer clipping member 36. The hinge 46 enables the outer clipping member 36 and the inner clipping member 20 to be resiliently pivoted relative to each other. The hinge 46 also provides for the inner clipping member 20 and the outer clipping member 36 to be in parallel planes, and to be nearly, but not exactly coplanar. The pivotal movement of the inner clipping member 20 and outer clipping member 36 enables one or more pieces of paper to be placed between the inner clipping member 20 and the outer clipping member 36, and enables the clip to be held in place on both sides of the paper. Ribs 58 are disposed along the first portion 40 of the outer clipping member 36 on each side of the hinge 46 in order to strengthen the outer clipping member, provide for greater flexibility of the hinge, and to accommodate pages of varying thicknesses. The ribs 58 extend in a direction parallel to the direction from the upper end 26 to the lower end 28 of the inner clipping member 20.

Figure 9:
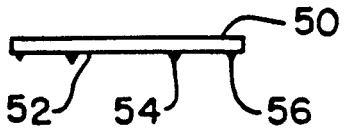
FIG. 9 is a top view of the ribbon cover shown in FIG.
Figure 10:
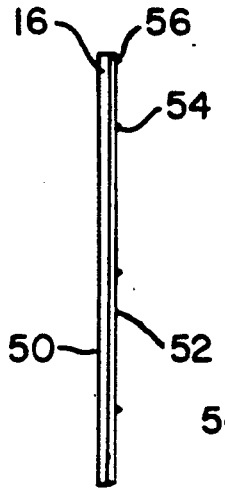
FIG. 10 is a side view of the ribbon cover shown in FIG. 8, viewed from the left.
Figure 8:
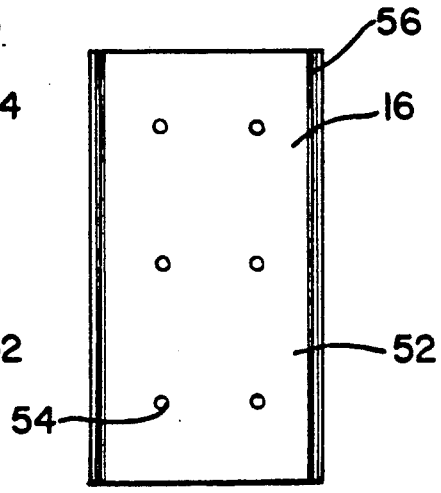
FIG. 8 is a back view of the ribbon cover used with the clip shown in FIG. 2.

FIGS. 8–10 illustrate the ribbon cover 16 used in conjunction with the embodiment of the clip 12 shown in FIGS. 2–7. Plastic ribbon cover 16 is planar, solid and rectangular, having a front face 50, and an opposite back face 52. The back face 52 is bonded sonically to the ribbon (not shown in FIGS. 8–10) and the clip 12 when the bookmark 10 is assembled. Back face 52 has two rows of small, plastic cone-shaped projections 54 which protrude outward. When the ribbon cover 16 is bonded to the clip 12, the cone-shaped projections 54 pierce the ribbon, melt, and then bond to the first face 20 of the clip 12. Elongated, triangular shaped lips 56, which project out of the plane of the ribbon cover 16, extend along two parallel sides of the back face 52 of the ribbon cover 16. Lips 56 melt and bond to the ledge 31 inside recess 30.

FIGS. 11–16 show another embodiment of the clip used in the bookmark of the present invention. The clip 12′ is substantially the same as the clip 12 of FIGS. 2–7. The clip 12′ shown in FIGS. 11–16 has a front face 22′ and an opposite back face 24′. The back face 24′ has a rectangular recess 30′ containing a partially recessed, three-sided outer ledge 31′ defining a rectangular, deeper inner recess 32′ which is dimensioned to receive a ribbon (not shown) and extends to the top edge of the clip 12′. Hinge 46′ connects the inner clipping member 20′ and the outer clipping member 36′, and provides for the outer clipping member 36′ to be set about 0.02 inches back from the plane of the inner clipping member 20′ i.e., inward in a direction parallel to the direction from the front face 22′ to the back face 24′. Gap 38′ separates the inner and outer clipping members 20′ and 36′ in a lateral direction, and also in the direction perpendicular to the plane of the inner clipping member 20′. Ribs 58′ are disposed along the first portion 40, of the outer clipping member 36′ on each side of the hinge 46′.

Figure 18:
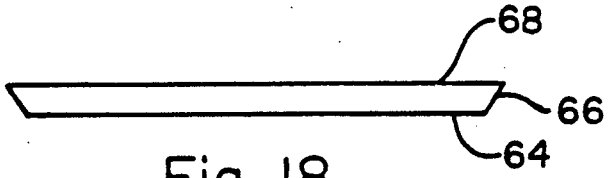
FIG. 18 is a top view of the name plate shown in FIG. 17.
Figure 17:
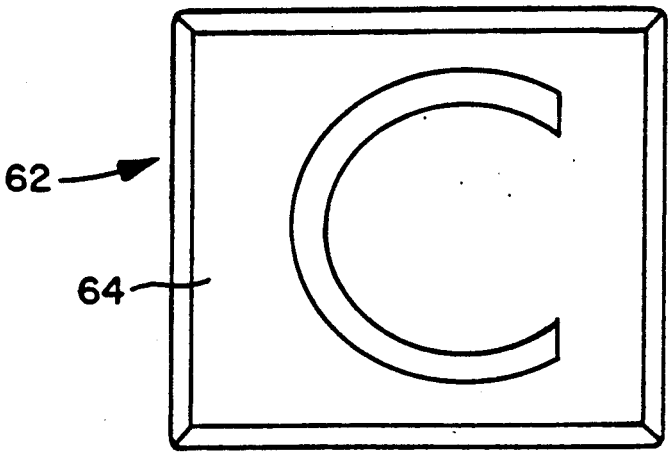
FIG. 17 is a front view of the name plate used with the clip shown in FIG. 11.
Figure 12:
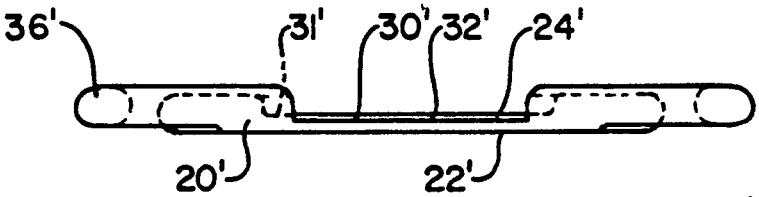
FIG. 12 is a top view, partly in phantom, of the clip shown in FIG. 11.
Figure 16:
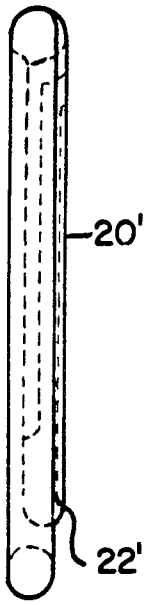
FIG. 16 is a side view, partly in phantom, of the clip shown in FIG. 8.
Figure 15:
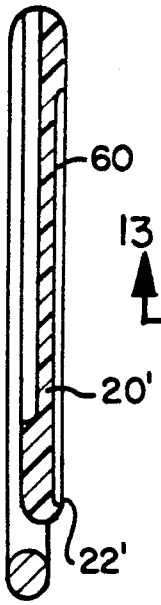
FIG. 15 is a cross-sectional view of the clip shown in FIG. 8, taken along line 15—15.
Figure 11:
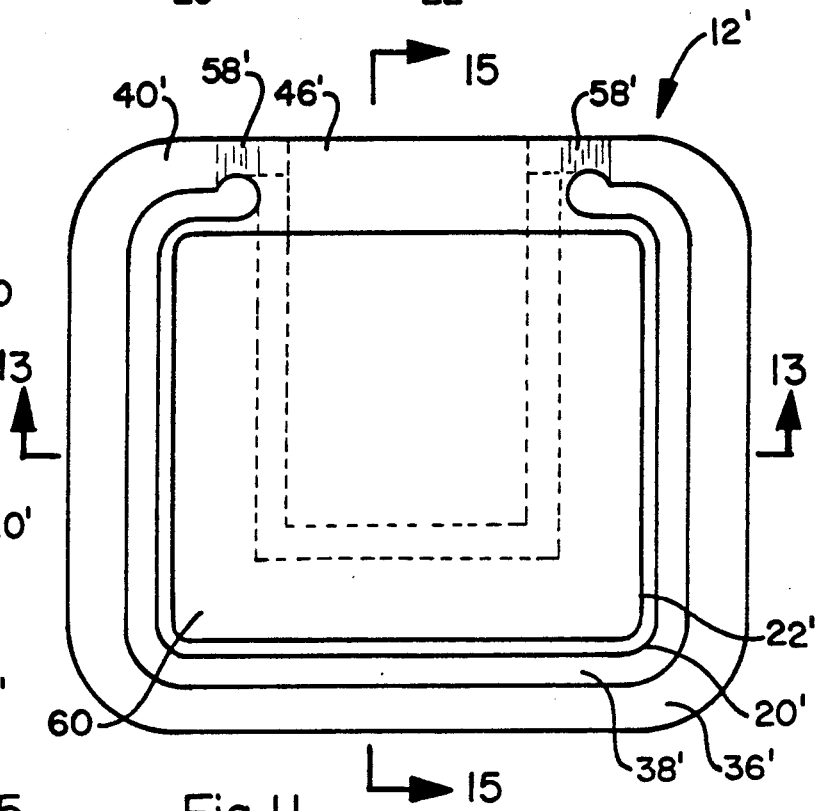
FIG. 11 is a front view, partly in phantom, of a second embodiment of a clip for the bookmark of the present invention.
Figure 13:
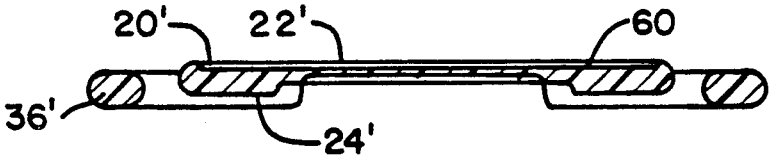
FIG. 13 is a cross-sectional view of the clip shown in FIG. 11, taken along line 13—13.
Figure 14:
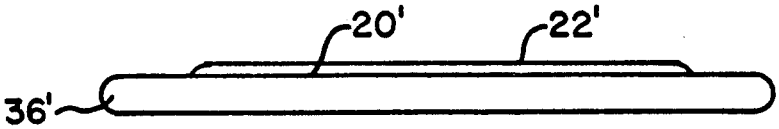
FIG. 14 is a bottom view of the clip shown in FIG. 11.

Unlike the clip 12 shown in FIGS. 2–7, clip 12′, shown in FIGS. 11–16, is adapted to receive a plastic name plate 62. The front face 22′ of the inner clipping member 20′ has a shallow rectangular recess 60 for receiving the name plate 62, shown in FIGS. 17–18. The name plate 62 has a front face 64 with a monogram displayed thereon, and a back face 68. The side walls 66 of the name plate 62 slant outward toward the back face 68, enabling the name plate 62 to snap-fit in the rectangular recess 60 of the clip 12. The name plate 62, which can be made of any suitable material, is fastened within the recess 60 using an adhesive.

In order to assemble a bookmark using the clip and ribbon cover of FIGS. 2–10, a ribbon (not shown) is sonic welded to the clip 12*a*, inside rectangular inner recess 32, with the ribbon extending outward through the top of the clip 12. The back face 52 of ribbon cover 16 is sonic bonded to the clip 12 over the ribbon 14, as described above. The bookmark using the clip shown in FIGS. 11–16 is assembled in the same way, and, also, the name plate 60 is mounted in the shallow rectangular recess 60 using an adhesive.

The bookmark of the invention preferably is used by fastening the clip to one or more pages of a book, or to the cover, and the ribbon is extended downward along the page to be marked. The page to which the bookmark is clipped is different than the page which is marked by the length of ribbon.

It is to be understood that the invention is not limited to the embodiments described above. For example, the sizes and shapes of the clip, ribbon, ribbon cover and name plate can vary, and the precise orientation of the inner and outer clipping members of the clip can vary. Other embodiments are within the spirit and scope of the invention, and fall within the scope of the claims.

What is claimed is:

1. A bookmark comprising, an elongated ribbon having a first end, a second end, a length and a width, a clip including:

a planar inner clipping member having a front face, a back face, a top portion, and a bottom portion, the back face having a rim defining a recess which receives the first end of the ribbon, the length of the ribbon being parallel to the direction from the top portion of the inner clipping member to the bottom portion, the inner clipping member having an outer edge along the rim, a planar outer clipping member extending around the outer edge of the inner clipping member, the outer clipping member including a first segment, and a second segment connected to the first segment, the first and second segments defining an inner edge having substantially the same shape as the outer edge of the inner clipping member, and hinge means integrally connecting the top portion of the inner clipping member to the first segment of the outer clipping member, allowing resilient, pivotal displacement of at least one of the inner and outer clipping members in a direction transverse to its plane, the unhinged inner edge of the outer clipping member being spaced at least about 0.03 inches from the outer edge of the inner clipping member, and a planar ribbon cover mounted on the back face of the inner clipping member, the ribbon being sandwiched between the inner clipping member and the ribbon cover.

2. A bookmark according to claim 1, wherein the inner and outer clipping members are of uniform thickness and are substantially, but not exactly coplanar.

3. A bookmark according to claim 2, wherein the inner clipping member lies in a plane parallel to the plane of the outer clipping member, and the plane of the inner clipping member is about 0.02 inches above the plane of the outer clipping member in a direction perpendicular to the direction from the back face to the front face of the inner clipping member.

4. A bookmark according to claim 1, wherein the clip and ribbon cover are plastic.

5. A bookmark according to claim 4, wherein the ribbon cover fits within the recess on the back face of the inner clipping member.

6. A bookmark according to claim 1, wherein the clip and ribbon cover are rectangular.

7. A bookmark according to claim 1, wherein the clip has a plate mounted on the front face of the inner clipping member, the plate having a letter or symbol displayed thereon.

8. A bookmark according to claim 7, wherein the front face of the inner clipping member has a shallow recess which receives the name plate.

9. A bookmark according to claim 1, wherein the length of the ribbon extends away from the clip in a direction from the bottom portion of the inner clipping member to the top portion.

10. A bookmark comprising, an elongated ribbon having a first end, a second end, a length and a width, a plastic clip including:

a planar, rectangular inner clipping member having a front face, a back face, a top portion and a bottom portion, the back face having a rim defining a rectangular recess which receives the first end of the ribbon, the length of the ribbon being parallel to the direction from the top portion of the inner clipping member to the bottom portion, the inner clipping member having an outer edge along the rim, a planar outer clipping member extending around the outer edge of the inner clipping member, the outer clipping member including a first segment, and a second segment connected to the first segment, the first and second segments defining an inner edge having substantially the same shape as the outer edge of the inner clipping member, and hinge means integrally connecting the top portion of the inner clipping member to the first segment of the outer clipping member, such that the inner and outer clipping members lie in parallel planes, and are nearly, but not exactly coplanar, the hinge means allowing resilient, pivotal displacement of at least one of the inner and outer clipping members in a direction transverse to its plane, the unhinged inner edge of the outer clipping member being spaced at least about 0.03 inches from the outer edge of the inner clipping member, and a planar ribbon cover mounted on the back face of the inner clipping member, the ribbon being sandwiched between the inner clipping member and the ribbon cover.

11. A bookmark according to claim 10, wherein the inner and outer clipping members are of uniform thickness.

12. A bookmark according to claim 10, wherein the plane of the inner clipping member is about 0.02 inches above the plane of the outer clipping member in a direction perpendicular to the direction from the back face to the front face of the inner clipping member.

13. A bookmark according to claim 10, wherein the ribbon cover is plastic.

14. A bookmark according to claim 10, wherein the outer clipping member is rectangular.

15. A bookmark according to claim 12, wherein the clip has a plate mounted on the front face of the inner clipping member, the plate having a letter or symbol displayed thereon.

16. A bookmark according to claim 12, wherein the front face of the inner clipping member has a shallow recess which receives the name plate.

* * * * *